United States Patent [19]

Gunther

[11] Patent Number: 4,603,508

[45] Date of Patent: Aug. 5, 1986

[54] WEATHER STOP

[76] Inventor: Robert C. Gunther, 292 Rose Ave., Staten Island, N.Y. 10306

[21] Appl. No.: 743,311

[22] Filed: Jun. 10, 1985

[51] Int. Cl.[4] ..... E06B 7/16

[52] U.S. Cl. ..... 49/493; 49/485

[58] Field of Search ..... 49/493, 489, 485

[56] References Cited

U.S. PATENT DOCUMENTS 160,555 3/1875 Underwood ..... 49/493
891,652 6/1908 Akre ..... 49/493
1,789,066 1/1931 Chadwick et al. ..... 49/493 X
2,922,204 1/1960 Mason ..... 49/493

*Primary Examiner*—Kenneth Downey
*Attorney, Agent, or Firm*—Richard L. Miller

[57] ABSTRACT

A weather stop that can be mounted to the jam of a door and including a door stop and a weather strip that is integrally attached to the door stop so that both the door stop and the weather strip are provided from one integral piece which can be cut to any desired length to fit the jam.

6 Claims, 3 Drawing Figures

WEATHER STOP

BACKGROUND OF THE INVENTION

The present invention relates to a weather stop. More particularly, it relates to a weather stop that includes a door stop and a weather seal.

Weather stops of the above-mentioned general type are known in the art. However, the known types require the use of a separate door jamb and a separate weather strip. The art does not teach the use of a weather strip integrally affixed to a door stop.

SUMMARY OF THE INVENTION

Accordingly, it is the primary object of the present invention is to provide a weather stop that avoids the disadvantages of the prior art.

Another object of the present invention is to provide a weather stop having the door stop and weather strip as one integral unit.

Still another object of the present invention is to provide a weather strip that seats efficiently in the door stop so as to provide a weather seal.

Yet another object of the present invention is to provide a weather stop having a door stop with a specific external configuration so as to be both eye appealing and structurally supportive.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
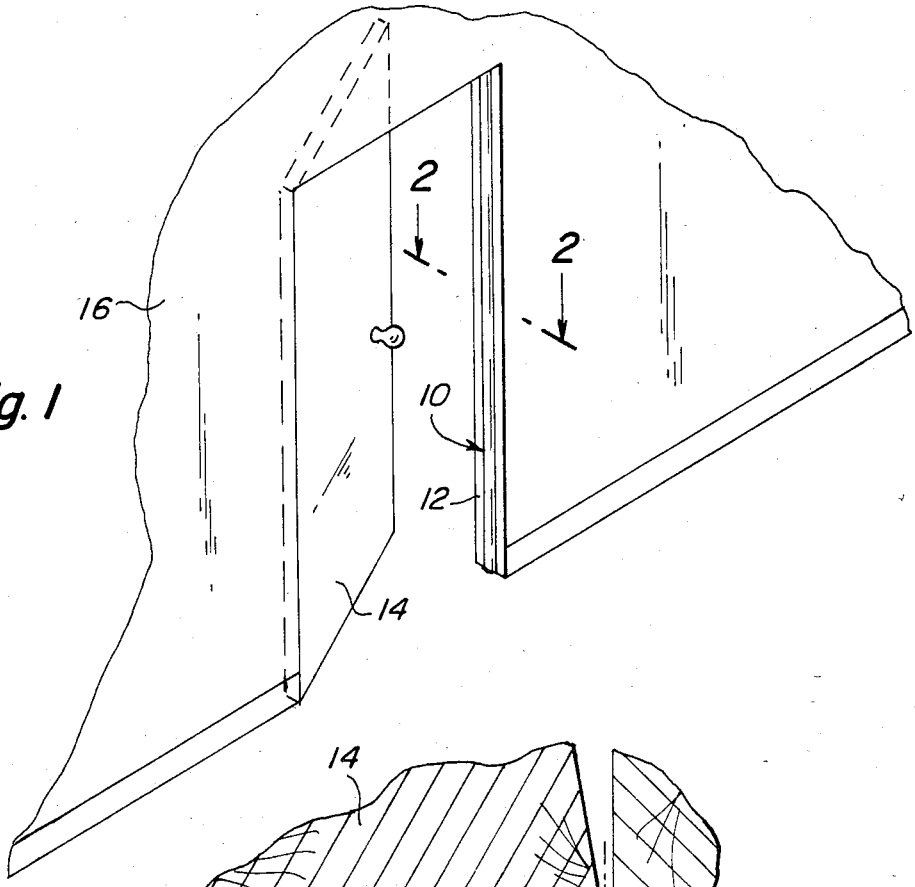
FIG. 1 is a perspective view of a door way showing the invention installed therein.

Referring now to FIG. 1, the weather stop of the present invention is shown generally at 10 mounted to a jamb 12 of a door 14 which is hinged to a wall 16.

Figure 2:
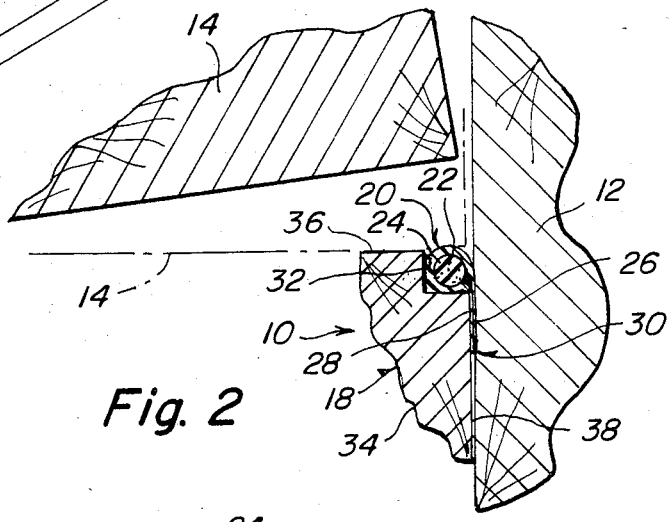
FIG. 2 is an enlarged cross sectional view taken along line 2—2 in FIG. 1.

As shown in FIG. 2, the weather stop 10 includes a door stop 18 and a weather strip 20, both traversing the entire lengths of the jamb 12 (sides and top).

The weather strip 20 consists of a central cylindrically shaped portion 22 composed of a resilient insulating material. An outer portion 24, also composed of a resilient material, is formed around the central cylindrically shaped portion 22 and has end portions 26 and 28 meeting each other to form a mounting flange 30.

The door stop 18 contains a square groove 32 at its corner that meets the door 14 and the jamb 12. The square groove 32 runs the entire length of the stop 18 and provides a seat for the weather strip 20. The external visible surface 34 of the stop 18 is formed with a specific bumpy shape so as to be both eye appealing and add structural soundness to the weather stop 10.

Figure 3:
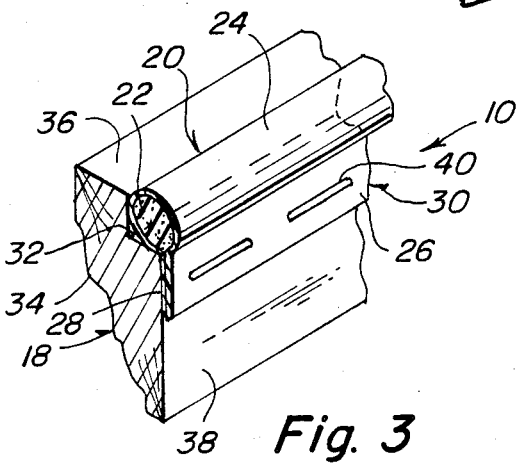
FIG. 3 is rear perspective view of the invention per se.

The weather strip 20, as shown in FIG. 3, is seated in the square groove 32 of the stop 18. The weather strip 20 protrudes both above the upper surface 36 of the stop 18 and past the rear surface 38 of the stop 18. These protrusions provide for a snug weather proofing installation. The weather strip 20 is attached to the stop 18 by staples 40 that pass through the flange 30 and into the rear surface 38 of the stop 18. When the stop 18 is mounted to the jamb 12, the weather strip 20 is held securely in place.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A weather stop, mounted to a jamb of a door which comprises:

(a) a door stop having a side surface facing the door against which the door directly abuts, a perpendicular side facing the jamb, a square groove at the corner between said two sides disposed where said door stop meets said jamb and said door, and (b) a cylindrically shaped resilient weather strip seated into said square groove and protruding beyond both said side surfaces for providing a snug weather proof seal both against the jamb and the door, means for securing said weather strip in said groove so that when the door is closed into the protrusion facing the door, a tight seal is formed with the door and the protrusion facing the jamb forms a tight seal around the jamb.

2. A weather stop as defined in claim 1, wherein said weather strip comprises, a cylindrically shaped central portion composed from a resilient insulating material.

3. A weather stop as defined in claim 2, wherein said weather strip further comprises an external resilient sheet that surrounds said cylindrically shaped central portion and includes a mounting flange.

4. A weather stop as defined in claim 3, wherein said mounting flange is radially offset and parallel to the diameter of the cylinder. corner where said door stop meets said jamb and said door.

5. A weather stop as defined in claim 1, further comprising said door stop with a side opposite said square groove formed in a bumpy shape so as to be both eye appealing and add structural strength to said weather stop.

6. A method of weather stripping a door jamb, which comprises:

(a) preparing a cylindrically shaped piece of resilient insulating material;

(b) wrapping entire circumference of said cylindrically shaped piece of resilient insulating material with a sheet of resilient material so that entire circumference of said cylindrically shaped piece of resilient insulating material is covered and a flange is formed by the meeting of the beginning and end portions of said sheet of resilient material;

(c) providing a square groove in the corner of the door stop, the door stop extending sufficiently beyond the groove to provide an abutting surface for direct abutment of the door;

(d) placing said wrapped piece of cylindrically shaped resilient insulating material into said square groove of said door stop so that said flange of said wrapped cylindrically shaped resilient insulating material piece rests on said blind side of said door stop, with said insulating material protruding from both sides of said door stop;

(e) stapling said flange of said wrapped cylindrically shaped resilient insulating material piece to said blind side of said door stop thus forming a weather strip; and (f) attaching combination of said door stop and weather strip combination to said door jamb.

* * * * *